US009404258B2

(12) United States Patent
Yun et al.

(10) Patent No.: US 9,404,258 B2
(45) Date of Patent: Aug. 2, 2016

(54) REINFORCING BAR CONNECTOR

(71) Applicant: Jangpyoung Construction Co., LTD., Seoul (KR)

(72) Inventors: Young-Su Yun, Seoul (KR); Byeong-Kwan Na, Incheon (KR)

(73) Assignee: Jangpyoung Construction Co., Ltd., Seoul (KR)

( * ) Notice: Subject to any disclaimer, the term of this patent is extended or adjusted under 35 U.S.C. 154(b) by 0 days.

(21) Appl. No.: 14/799,972

(22) Filed: Jul. 15, 2015

(65) Prior Publication Data

US 2016/0130814 A1 May 12, 2016

(30) Foreign Application Priority Data

Nov. 12, 2014 (KR) ..... 10-2014-0156854

(51) Int. Cl.

| | |
|---|---|
| ***E04B 1/38*** | (2006.01) |
| ***E04C 5/00*** | (2006.01) |
| ***E04C 5/16*** | (2006.01) |
| ***E04B 1/58*** | (2006.01) |

(52) U.S. Cl.

CPC ..... *E04C 5/165* (2013.01); *E04B 1/585* (2013.01); *E04B 2001/5875* (2013.01); *E04B 2001/5887* (2013.01)

(58) Field of Classification Search

CPC ..... E04C 5/165; E04C 5/16; E04C 5/18; E04B 1/585; E04B 2001/5875; E04B 2001/5887; E04G 21/12; Y10T 403/7067; Y10T 403/7066; Y10T 403/5786; F16B 7/182; F16B 37/0892

See application file for complete search history.

(56) References Cited

U.S. PATENT DOCUMENTS

| | | | | |
|---|---|---|---|---|
| 1,857,022 | A * | 5/1932 | Hingley | 403/305 |
| 3,694,012 | A * | 9/1972 | Gelfand | E04C 5/165 403/306 |
| 3,701,555 | A * | 10/1972 | Harris | 403/303 |
| 3,737,975 | A * | 6/1973 | McKinnon, Jr. | 29/421.1 |
| 3,982,779 | A * | 9/1976 | Hickey | 285/328 |
| 4,469,465 | A * | 9/1984 | Andrus | 403/282 |
| 5,681,126 | A * | 10/1997 | Lin | 403/313 |
| 8,181,999 | B2 * | 5/2012 | Cromarty | 285/419 |
| 2004/0071507 | A1 * | 4/2004 | Kim | 403/368 |
| 2006/0053735 | A1 * | 3/2006 | Kim | 52/726.1 |
| 2012/0266441 | A1 * | 10/2012 | Parente et al. | 29/428 |

FOREIGN PATENT DOCUMENTS

| | | |
|---|---|---|
| KR | 200223677 | 5/2001 |
| KR | 101389825 | 4/2014 |

* cited by examiner

*Primary Examiner* — Brian Mattei

(74) *Attorney, Agent, or Firm* — Hunter E. Webb; Keohane & D'Alessandro, PLLC

(57) ABSTRACT

In general, embodiments of the present invention relate to a reinforcing bar connector. Specifically, the present invention provides a reinforcing bar connector including a holder and a binding member. The holder includes a first cover and a second cover. The holder is inserted into the binding member with the reinforcing bars surrounded by the holder. The first cover and the second cover are moved independently from each other enabling a secure connection between the reinforcing bars regardless of whether the reinforcing bars have the same or different lug arrays.

20 Claims, 8 Drawing Sheets

B-B'

REINFORCING BAR CONNECTOR

CROSS-REFERENCE TO RELATED APPLICATION

This application claims the benefit of Korean patent application No. 10-2014-0156854, filed on Nov. 12, 2014.

TECHNICAL FIELD

The present invention relates to a reinforcing bar connector. Specifically, the present invention provides a reinforcing bar connector which enables a secure connection between reinforcing bars regardless of whether the reinforcing bars have the same or different lug arrays.

BACKGROUND

Reinforcing bars (hereinafter, "rebars") are common steel bars that are hot rolled and used widely in the construction industry, especially for concrete reinforcement. Steel rebars are most commonly used as tensioning devices to reinforce concrete and other masonry structures to help hold the concrete in a compressed state. Concrete is a material that is very strong in compression, but virtually without strength in tension. To compensate for this imbalance in a concrete slab's behavior, reinforcement bars are cast into it to carry the tensile loads. It is also desirable to connect rebars in these applications.

Various methods have been implemented for connecting rebars including welding or using binding wires. However, such conventional rebar connectors can be difficult for the worker to manipulate due to their complicated structures. Furthermore, deformed rebars from different sources may come with different lug arrays which require different types of connectors when coupling.

SUMMARY

In general, embodiments of the present invention relate to a reinforcing bar connector. Specifically, the present invention provides a reinforcing bar connector including a holder and a binding member. The holder includes a first cover and a second cover. The holder is inserted into the binding member with the reinforcing bars substantially surrounded by the holder. The first cover and the second cover are moved independently from each other enabling a secure connection between the reinforcing bars regardless of whether the reinforcing bars have the same or different lug arrays.

One aspect of the present invention provides a reinforcing bar connector connecting the ends of two aligned and abutting reinforcing bars, comprising: a holder, wherein the holder includes a first cover and a second cover, wherein an top portion of the first cover is pivotally hinged to an top portion of the second cover; wherein the first cover is configured to surround a portion of an outer circumferential surface of a first reinforcing bar and second reinforcing bar; wherein the second cover is configured to surround a remaining portion of the outer circumferential surface of the first reinforcing bar and second reinforcing bar; and a binding member configured to bind a bottom portion of the first cover to a bottom portion of the second cover.

A second aspect of the present invention provides a method connecting the ends of two aligned and abutting reinforcing bars, comprising: pivotally hinging an top portion of a first cover of a holder to an top portion of a second cover of the holder; surrounding a portion of an outer circumferential surface of a first reinforcing bar and second reinforcing bar by the first cover; surrounding a remaining portion of the outer circumferential surface of the first reinforcing bar and second reinforcing bar by the second cover; and binding a bottom portion of the first cover to a bottom portion of the second cover using a binding member.

BRIEF DESCRIPTION OF THE DRAWINGS

These and other features of this invention will be more readily understood from the following detailed description of the various aspects of the invention taken in conjunction with the accompanying drawings in which.

Figure 1:
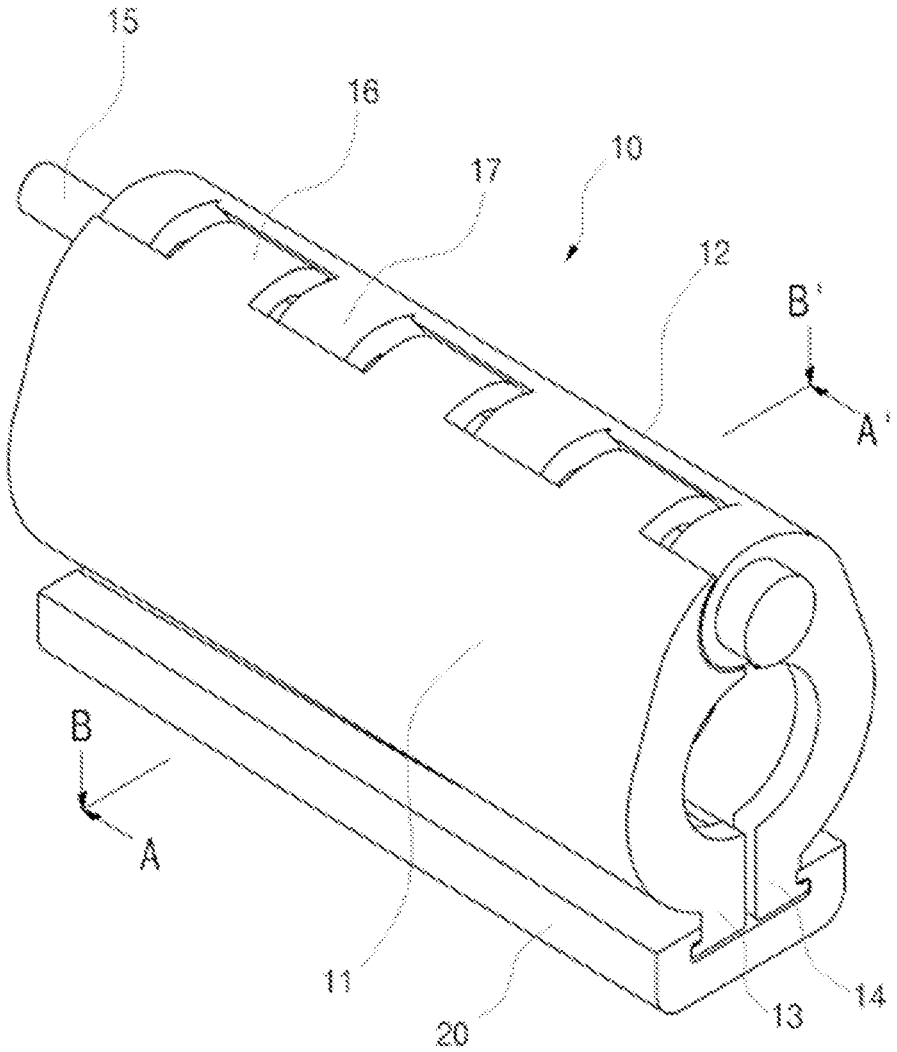
FIG. 1 is a perspective view illustrating a rebar connector according to an embodiment of the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

Illustrative embodiments will now be described more fully herein with reference to the accompanying drawings, in which exemplary embodiments are shown. This disclosure may, however, be embodied in many different forms and should not be construed as limited to the embodiments set forth herein. Rather, these illustrative embodiments are provided so that this disclosure will be thorough and complete and will fully convey the scope of this disclosure to those skilled in the art. In the description, details of well-known features and techniques may be omitted to avoid unnecessarily obscuring the presented embodiments.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. It will be further understood that the terms "comprises" and/or "comprising", or "includes" and/or "including", when used in this specification, specify the presence of stated features, regions, integers, steps, operations, elements, and/or components, but do not preclude the presence or addition of one or more other features, regions, integers, steps, operations, elements, components, and/or groups thereof.

It will be further understood that when an element or layer is referred to as being "on," "connected to," or "coupled to" another element or layer, it can be directly on, connected, or coupled to the other element or layer, or intervening elements or layers may be present.

As indicated above, embodiments of the present invention relate to a reinforcing bar connector. Specifically, the present invention provides a reinforcing bar connector including a holder and a binding member. The holder includes a first cover and a second cover. The holder is inserted into the binding member with the reinforcing bars surrounded by the holder. The first cover and the second cover are moved independently from each other enabling a secure connection between the reinforcing bars regardless of whether the reinforcing bars have the same or different lug arrays.

FIG. 1 is a perspective view illustrating a rebar connector according to an embodiment of the present invention. The rebar connector can comprise one or more of the following materials: stainless steel, aluminum, titanium, other metals, plastics, ceramics, carbon fiber and/or the like. As shown, the rebar connector includes a holder 10 and a binding member 20. The holder 10 includes a first cover 11 and a second cover 12. Each of the first cover 11 and the second cover 12 has a surface that is shaped in such a way as to abut an outer axial surface of a piece of rebar. To this extent, the first cover 11 and second cover 12 can be shaped substantially as semicircular arcs. At one edge (top portion) of the semicircular arc of first cover 11 is located a rotational coupling mechanism 16. Similarly, at a corresponding edge (top portion) of the semicircular arc of second cover 12 is located a corresponding rotational coupling mechanism 17. Rotational coupling mechanism 16 interfaces with corresponding rotational coupling mechanism 17 to produce a "clam shell" coupling between the first cover 11 and the second cover 12. To this extent, rotational coupling mechanism 16 and corresponding rotational coupling mechanism 17 can include one or more hinge protrusions, ball and socket, saddle, gliding, and/or any other type of rotational coupler now known or later developed. In an embodiment, the top portion of first cover 11 includes one or more first hinge protrusions 16 and the top portion of second cover 12 includes one or more second hinge protrusions 17. The top portion of the first cover 11 is hinged with the top portion of the second cover 12 using the interlaced first hinge protrusions 16 and second hinge protrusions 17.

Figure 2:
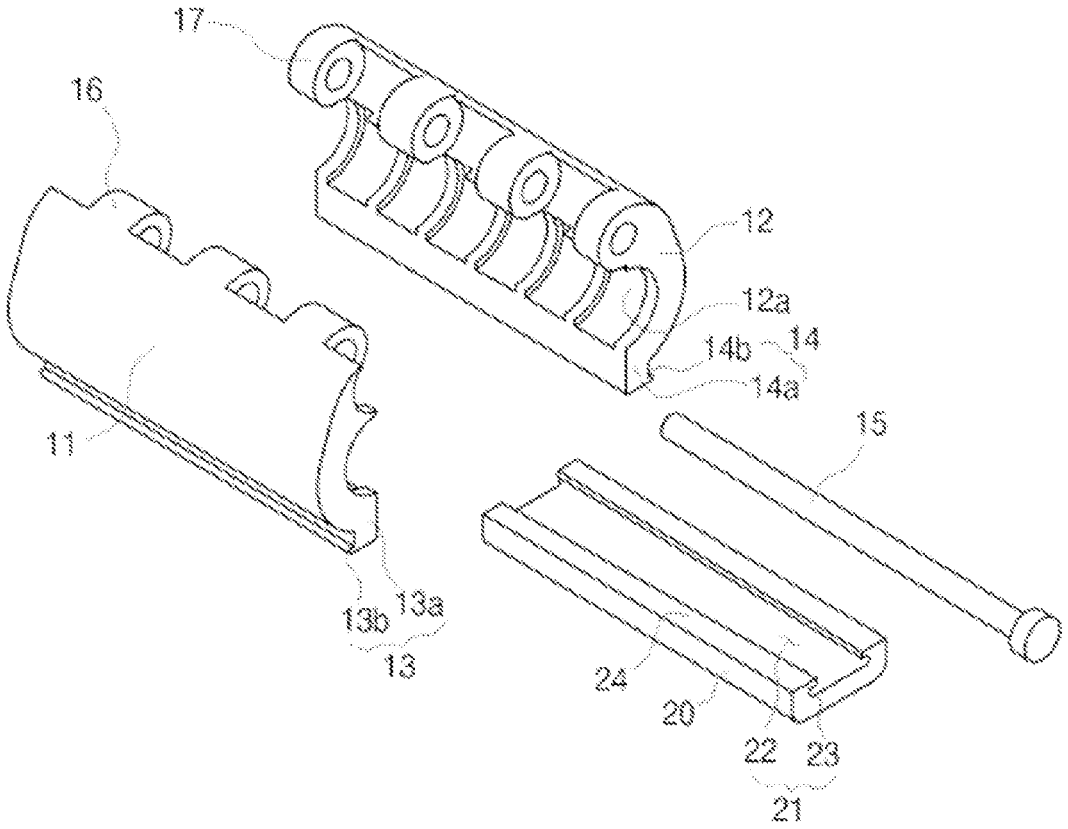
FIG. 2 is an exploded perspective view illustrating a rebar connector in a direction according to an embodiment of the present invention.
Figure 3:
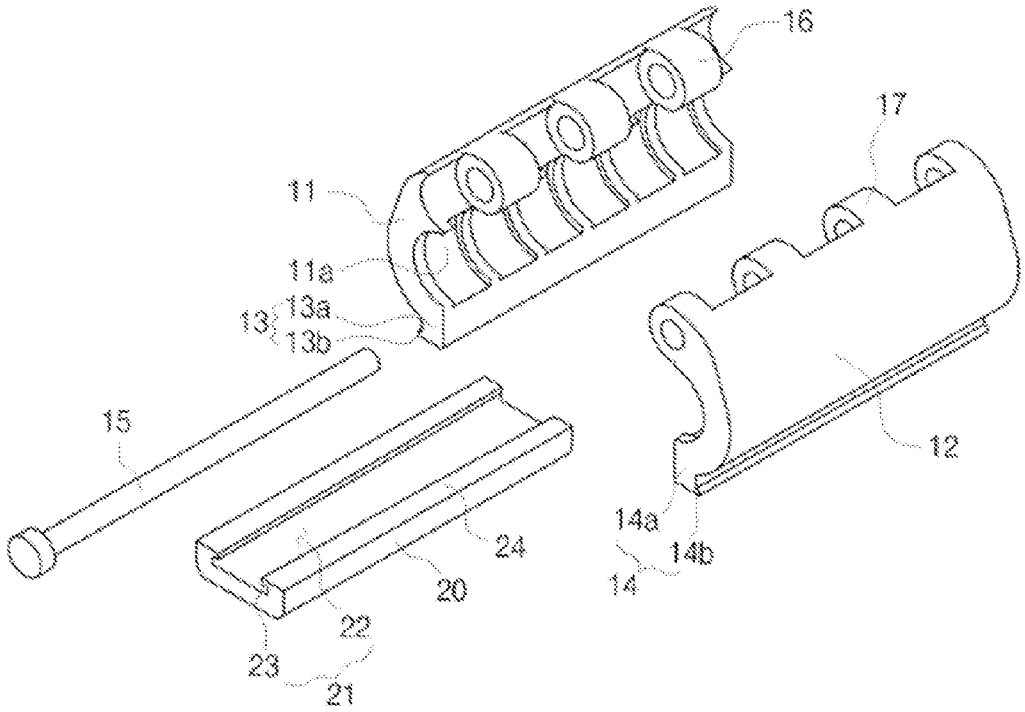
FIG. 3 is an exploded perspective view illustrating a rebar connector in another direction according to an embodiment of the present invention.

FIGS. 2-3 are exploded perspective views illustrating a rebar connector shown from different angles. As shown, the rebar connector in FIGS. 2-5 further depicts a more detailed view of first jaw 13 and second jaw 14. The portion of first cover 11 opposite the semicircular arc from the rotational coupler (bottom portion) includes first jaw 13. Similarly, the portion of second cover 12 opposite the semicircular arc from the rotational coupler (bottom portion) includes second jaw 14. First jaw 13 and second jaw 14 can be shaped in such a way as to be coupled with binding member 20. In one embodiment, first jaw 13 includes a first protrusion 13*a* and a first bend 13*b*. Second jaw 14 includes a second protrusion 14*a* and a second bend 14*b*. The first protrusion 13*a* externally projects from the lower end of the first cover 11. The first bend 13*b* is bent from the first protrusion 13*a* in an opposite direction of second bend 14*b*. The second protrusion 14*a* externally projects from the lower end of the second cover 12. The second bend 14*b* is bent from the second protrusion 14*a* in an opposite direction of the first bend 13*b*. Accordingly, the first bend 13*b* and the second bend 14*b* are bent in opposite directions.

The top portion of first cover 11 can be coupled to the top portion of second cover 14. In one embodiment, shaft 15 includes an elongated bolt portion with a shaft head. The shaft 15 hinges the top portion of the first cover 11 with the top portion of the second cover 12, so that the first cover 11 and the second cover 12 may pivot about each other. In other words, the first cover 11 and the second cover 12 are pivotally hinged to each other by the shaft 15. Alternatively, the top portion of the first cover 11 and the top portion of the second cover 12 may be formed thin enough to, when directly connected with each other without the shaft 15, allow them to be folded or unfolded to surround successive rebars.

The bottom portion of first cover 11 may be bound to the bottom portion of second cover 12. In one embodiment, binding member 20 includes a fitting groove 21 used to bind the bottom portion of first cover 11 and the bottom portion of second cover 12. The binding member 20 includes a fitting groove 21 where the first jaw 13 and the second jaw 14 are fitted and fastened. The fitting groove 21 includes a first fitting part 22 to which the first protrusion 13*a* and the second protrusion 14*a* are inserted and a second fitting part 23 to which the first bend 13*b* and the second bend 14*b* are inserted. The binding member 20 has guiding ridges 24 at both sides, forming the first fitting part 22 and the second fitting part 23.

Figure 4:
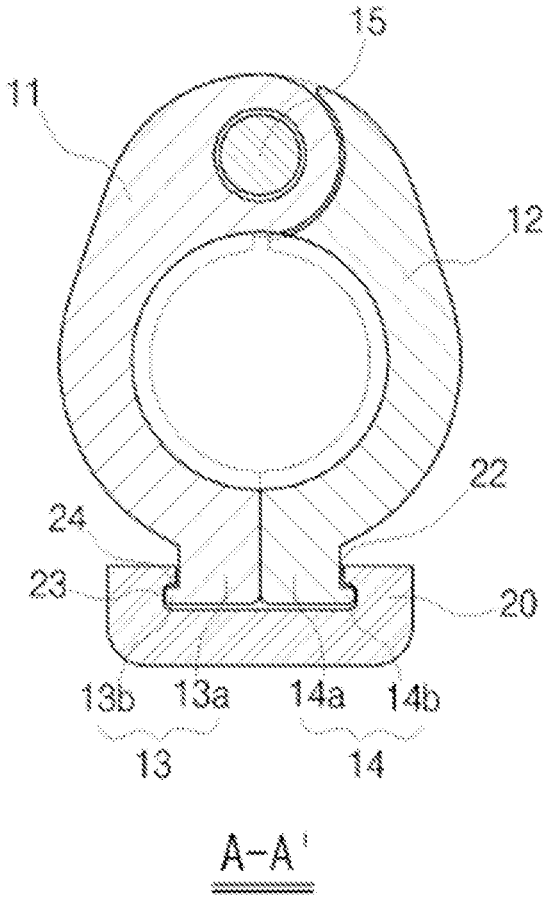
FIG. 4 is a cross-sectional view taken along line A-A' of FIG. 1.
Figure 5:
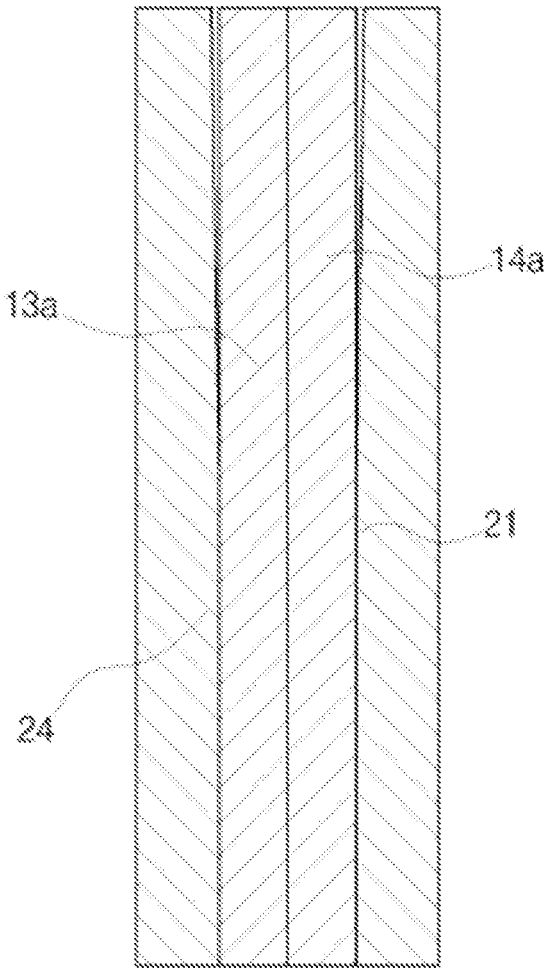
FIG. 5 is a cross-sectional view taken along line B-B' of FIG. 1.

As shown in FIG. 4, the first bend 13*b* and the second bend 14*b* inserted into the second fitting part 23 are restricted by the guiding ridges 24, stopping them from escaping in a vertical direction. In this case, the first cover 11 and the second cover 12 constituting the holder 10, as fitted into the fixing groove 21, are more firmly joined together. The first fitting part 22 is reduced in width by the guiding ridges 24 from an end to another, as shown in FIG. 5. In other words, each guiding ridge 24 respectively formed at both sides of the first fitting part 22 is inclined from an end to another, so that the width of the first fitting part 22 is gradually reduced from an end to another.

With reference to the remaining figures (FIGS. 6A-C, 7A-C, and 8A-C), processes for connecting deformed rebars are described in detail below. In each process, the holder 10 surrounds rebars 30 (e.g., first rebar 31 and the second rebar 32) arranged in a line such that the first rebar 31 abuts the second rebar 32. As described above, each of the first cover 11 and the second cover 12 has a surface that is shaped in such a way as to abut an outer axial surface of a piece of rebar. To this extent, the first cover 11 and second cover 12 can be shaped substantially as semicircular arcs. The first cover 11 can partially surround the outer circumferential surface of the rebars 30, while the second cover 12 can substantially surround the remaining portions of rebars 30 not surrounded by the first cover 11.

The first cover 11 has first seating recesses 11*a* formed in an inner surface to seat lugs 30*a* and 30*b* of the rebars 30. The second cover 12 has second seating recesses 12*a* formed in an inner surface to seat the lugs 30*a* and 30*b* of the rebars 30. The first cover 11 and the second cover 12 may be positioned laterally in an offset configuration with respect to one another to vary the position of the first seating recesses 11*a* and the second seating recesses 12*a*. For example, in the embodiment having shaft 15 described herein, the first cover 11 and the second cover 12 may be slid along the shaft 15 independently from each other to vary the position of the first seating recesses 11*a* and the second seating recesses 12*a*.

In this embodiment, the top portion of the first cover 11 has multiple first hinge protrusions 16, and the top portion of the second cover 12 has multiple second hinge protrusions 17. The shaft 15 passes through the first hinge protrusions 16 and the second hinge protrusions 17 that are alternately and repetitively arranged. The gap between two neighboring ones of the first hinge protrusions 16 is larger than the width of each of the second hinge protrusions 17 arranged in a longitudinal direction of the shaft 15.

Accordingly, each second hinge protrusion 17 disposed between its corresponding two first hinge protrusions 16 may be moved along the shaft 15, allowing the first cover 11 and the second cover 12 to travel along the shaft 15 independently from each other. As such, since the first cover 11 and the second cover may be moved independently from each other, the first seating recesses 11*a* formed in the first cover 11 and the second seating recesses 12*a* formed in the second cover 12 may be repositioned.

Figure 6A:
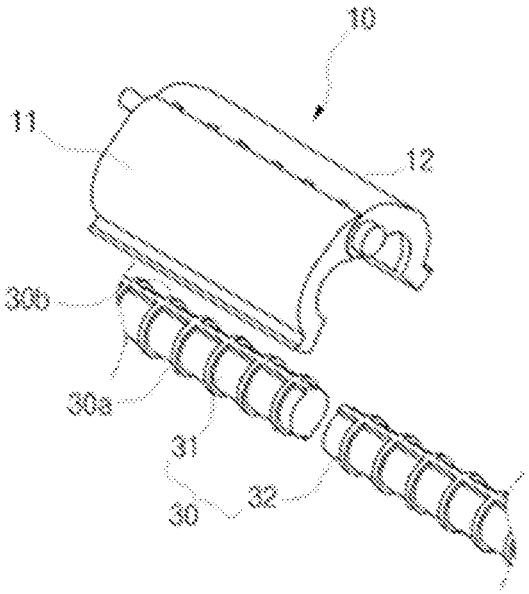
FIGS. 6A-C are views illustrating a process of connecting deformed rebars with the same lug array according to an embodiment of the present invention.
Figure 6B:
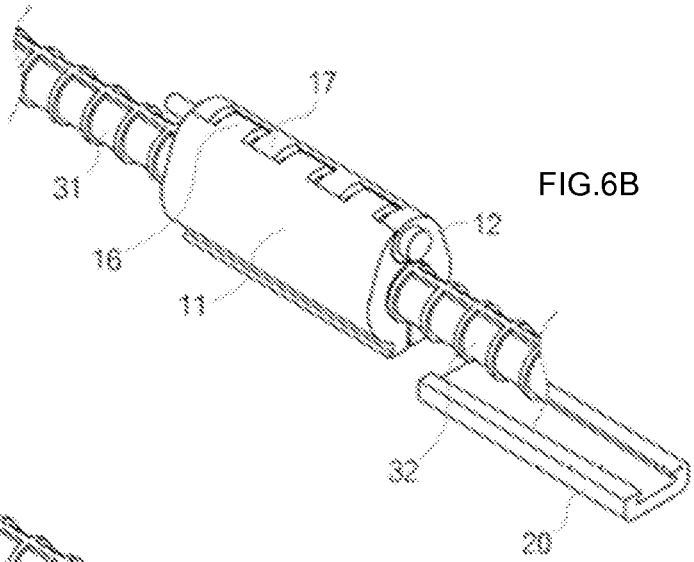

For deformed rebars 30 with the same lug array 30*a* and 30*b* formed on the outer circumferential surface as shown in FIG. 6A, the first rebar 31 and the second rebar 32 are surrounded along their outer circumferential surface by the first cover 11 and the second cover 12 as shown in FIG. 6B.

Figure 6C:
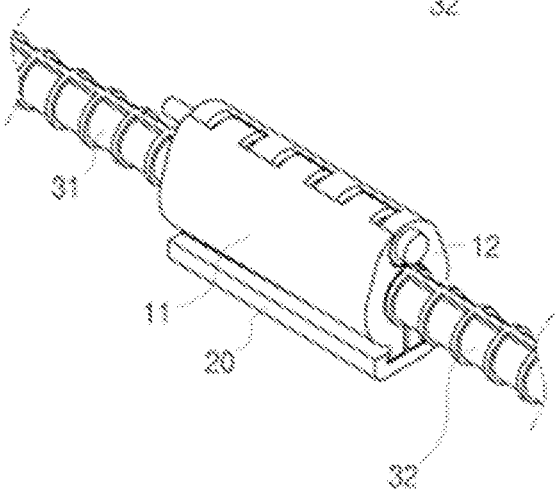

In this case, the first seating recesses 11*a* are connected to the second seating recesses 11*b*, respectively, forming cylindrical spaces, and the respective lug arrays 30*a* and 30*b* of the rebars 30 are positioned in the cylindrical spaces. Thereafter, the first jaw 13 and the second jaw 14 are inserted into the binding member 20 through the fitting groove 21 from an end of the binding member 20 to another, as shown in FIG. 6C.

The first protrusion 13*a* and the second protrusion 14*a* are placed in the first fitting part 22, and the first bend 13*b* and the second bend 14*b* are placed in the second fitting part 23. As the holder 10 is inserted into the binding member 20 from an end of the binding member 20 to another, the first bend 13*b* and the second bend 14*b* are moved along the first fitting part 22.

The first fitting part 22 is formed such that the width is reduced by the guiding ridges 24 from an end of the binding member 20 to another. Accordingly, as the holder 10 travels to the other end of the binding member 20, the first bend 13*b* and the second bend 14*b* are gradually pressurized, allowing the first cover 11 and the second cover 12 to be pressingly joined together.

Figure 7A:
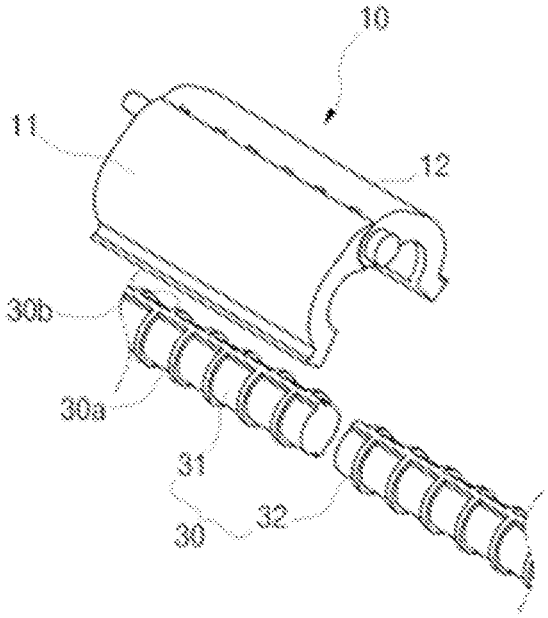
FIGS. 7A-C are views illustrating a process of connecting deformed rebars with different lug arrays according to an embodiment of the present invention.

As shown in FIG. 7A, even when the rebars 30 with different lug arrays come in use, the lug arrays of the rebars 30 may be positioned in place in the first seating recesses 11*a* and the second seating recesses 12*a* by adjusting the first cover 11 and the second cover 12 as described below. Accordingly, as the holder 10 is put in the fitting groove 21 from an end of the fitting groove 21 to another, the first protrusion 13*a* and the second protrusion 14*a* are gradually pressed against the guiding ridges 24, allowing the first cover 11 and the second cover 12 to be joined together more firmly.

Alternatively, the width of the first fitting part 22 may remain constant while the width of the second fitting part 23 is decreased from an end to another. Hence, as the holder 10 is inserted into the fitting groove 21 from an end to another, the first bend 13*b* and the second bend 14*b* may be gradually pushed against the second fitting part 23, allowing the first cover 11 and the second cover 12 to be joined together more firmly.

Figure 7B:
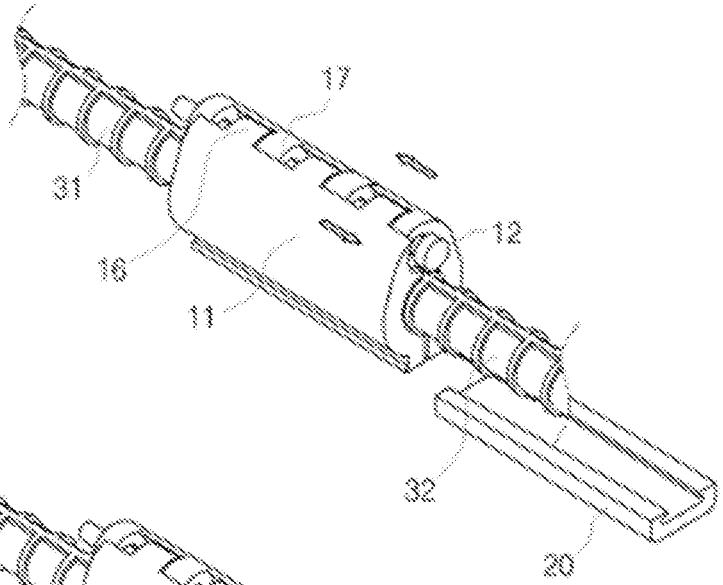

For deformed rebars 30 respectively with different lug arrays 30*a* and 30*b* formed on the outer circumferential surface, the first cover 11 and the second cover 12 are moved along the shaft 15 as shown in FIG. 7B. Then, the first seating recesses 11*a* and the second seating recesses 12*a* are alternately arranged with respect to each other, and the respective lug arrays 30*a* and 30*b* of the rebars 30 are placed in the first seating recesses 11*a* and the second seating recesses 12*a* alternately arranged.

Figure 7C:
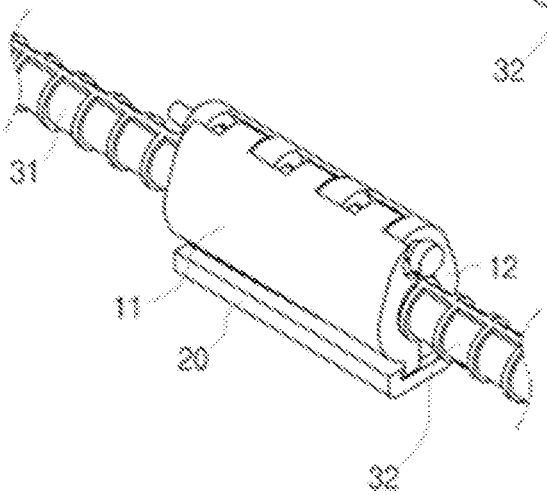

The holder is then fitted and fastened into the binding member 20 as shown in FIG. 7C. As described above, the first cover 11 and the second cover 12 may be moved independently from each other, allowing for an easy connection between deformed rebars even with different lug arrays.

According to an embodiment of the present invention, the two rebars 30 may be easily connected by inserting the holder 10 into the binding member 20 with the tapered fitting groove 21, with the holder 10 surrounding the two rebars 30. As described above, the rebar connector may apply to rebars 30 with different lug arrays, as well as rebars 30 with the same lug array, providing for better compatibility. The first rebar 31 and the second rebar 32 may be inserted into the holder 10, with the holder 10 partially joined with the binding member 20.

Figure 8A:
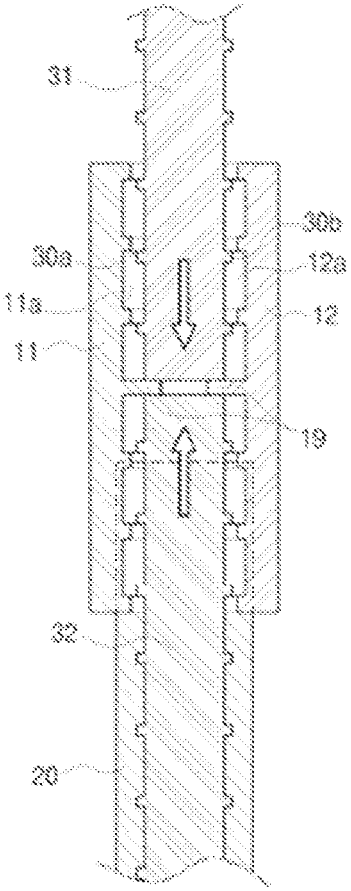
FIGS. 8A-C are views illustrating a process of connecting deformed rebars according to an embodiment of the present invention.
Figure 8B:
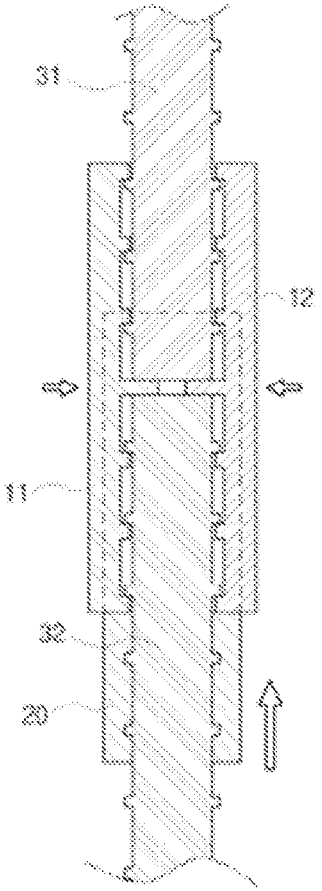
Figure 8C:
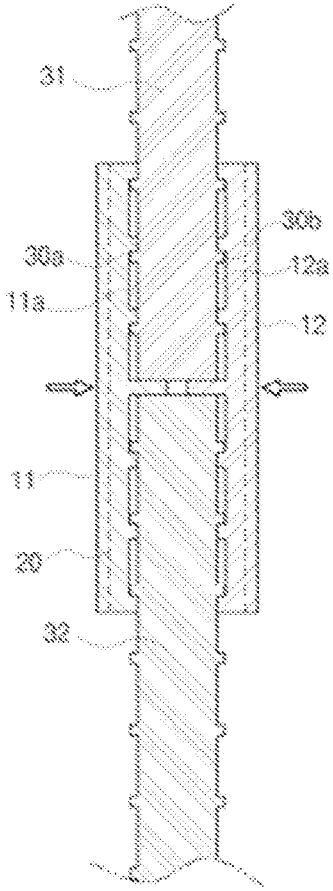

FIGS. 8A-C are views illustrating a process of connecting deformed rebars according to another embodiment of the present invention. First, as shown in FIG. 8A, the first rebar 31 and the second rebar 32 are inserted into the holder 10, with the first jaw 13 and the second jaw 14 of the holder 10 partially inserted into the fitting groove 21. In this case, the distance between an inner circumferential surface of the first cover 11 and an inner circumferential surface of the second cover 12 may be larger than the maximum diameter of the rebars 30, so that the first rebar 31 and the second rebar 32 may be easily inserted into a space between the first cover 11 and the second cover 12. The first cover 11 and the second cover 12, respectively, have a restraining apparatus 19 projecting from the inner circumferential surfaces. Each restraining apparatus 19 restricts the insertion of the rebars 30 to predetermined depths by stopping the first rebar 31 and the second rebar 32. Accordingly, the two rebars 30 may be inserted into the holder 10 to the same depth.

The holder 10 is then slid along the tapered fitting groove 21 to allow the first cover 11 and the second cover 12 to come closer to each other, as shown in FIG. 8B. As the first cover 11 and the second cover 12 come closer to each other, the lugs of the rebars 30 are positioned in place in the first seating recesses 11*a* and the second seating recesses 12*a*. Further slid from the position, the holder 10 is forcedly fitted into the binding member 20 as shown in FIG. 8C.

The foregoing description of various aspects of the invention has been presented for purposes of illustration and description. It is not intended to be exhaustive or to limit the invention to the precise form disclosed and, obviously, many modifications and variations are possible. Such modifications and variations that may be apparent to a person skilled in the art are intended to be included within the scope of the invention as defined by the accompanying claims.

What is claimed is:

1. A reinforcing bar connector connecting the ends of two aligned and abutting reinforcing bars, comprising:

a holder, wherein the holder includes a first cover and a second cover, wherein a top portion of the first cover is pivotally hinged to a top portion of the second cover in a configuration that enables the first cover to adjust a lateral position into an offset position with respect to the second cover, wherein the first cover is configured to surround a portion of an outer circumferential surface of a first reinforcing bar and second reinforcing bar, wherein the second cover is configured to surround a remaining portion of the outer circumferential surface of the first reinforcing bar and second reinforcing bar, wherein the first cover includes one or more first hinge protrusions and the second cover includes one or more second hinge protrusions, wherein the one or more first hinge protrusions and the one or more second hinge protrusions are alternately and repetitively arranged with a gap between each first hinge protrusions and each adjacent second hinge protrusion that enables adjusting of the lateral position into the offset position, and a binding member configured to bind a bottom portion of the first cover to a bottom portion of the second cover.

2. The reinforcing bar connector of claim 1, wherein each of the one or more first hinge protrusions and the one or more second hinge protrusions includes a hole.

3. The reinforcing bar connector of claim 2, further comprising a shaft, wherein the shaft is configured to pass through each hole of the one or more first protrusions and one or more second hinge protrusions in a direction along which the first reinforcing bar and the second reinforcing bar are aligned to pivotally hinge the top portion of the first cover to the top portion of the second cover.

4. The reinforcing bar connector of claim 1, wherein the bottom portion of the first cover includes a first jaw and the bottom portion of the second cover includes a second jaw.

5. The reinforcing bar connector of claim 4, wherein the first jaw includes a first protrusion externally projecting from the bottom portion of the first cover and a first bend bent from the first protrusion, wherein the second jaw includes a second protrusion externally projecting from the bottom portion of the second cover and a second bend bent from the second protrusion, wherein the first bend and the second bend are bent in opposite directions.

6. The reinforcing bar connector of claim 5, wherein the binding member further includes a fitting groove configured to receive the first jaw and the second jaw in a direction along which the first reinforcing bar and the second reinforcing bar are aligned.

7. The reinforcing bar connector of claim 6, wherein the fitting groove includes a first fitting part configured to receive the first protrusion and the second protrusion and a second fitting part configured to receive the first bend and the second bend.

8. The reinforcing bar connector of claim 7, wherein the binding member includes a first guiding ridge configured to form the first fitting part and a second guiding ridge configured to form the second fitting part, wherein the first guiding ridge and second guiding ridge are configured to restrain the first bend and the second bend from moving in a vertical direction when inserted into the second fitting part.

9. The reinforcing bar connector of claim 8, wherein a width of the first fitting part is reduced by the first guiding ridge as the holder is inserted into the binding member along the fitting groove.

10. The reinforcing bar connector of claim 8, wherein a width of the second fitting part is reduced by the second guiding ridge as the holder is inserted into the binding member along the fitting groove.

11. The reinforcing bar connector of claim 3, wherein an inner surface of the first cover includes one or more first seating recesses to seat a first lug array formed in the first reinforcing bar and an inner surface of the second cover includes one or more second seating recesses to seat a second lug array formed in the second reinforcing bar, wherein the adjusting positions the one or more second seating recesses to seat the second lug array while the one or more first seating recesses remain in a position to seat the first lug array.

12. The reinforcing bar connector of claim 11, wherein the first cover and the second cover are further configured to slide along the shaft independent of each other to vary a position of the first seating recesses and the second seating recesses.

13. The reinforcing bar connector of claim 1, wherein at least one of the first cover or the second cover includes a restraining apparatus configured to restrict an insertion of at least one of the first reinforcing bar or second reinforcing bar to a predetermined depth.

14. A method connecting the ends of two aligned and abutting reinforcing bars, comprising:

pivotally hinging a top portion of a first cover of a holder to a top portion of a second cover of the holder in a configuration that enables the first cover to adjust a lateral position into an offset position with respect to the second cover; wherein the first cover includes one or more first hinge protrusions and the second cover includes one or more second hinge protrusions, wherein the one or more first hinge protrusions and the one or more second hinge protrusions are alternately and repetitively arranged with a gap between each first hinge protrusions and each adjacent second hinge protrusion that enables adjusting of the lateral position into the offset position, surrounding a portion of an outer circumferential surface of a first reinforcing bar and second reinforcing bar by the first cover;

surrounding a remaining portion of the outer circumferential surface of the first reinforcing bar and second reinforcing bar by the second cover; and binding a bottom portion of the first cover to a bottom portion of the second cover using a binding member.

15. The reinforcing bar connector of claim 14, wherein each of the one or more first hinge protrusions and the one or more second hinge protrusions includes a hole.

16. The method of claim 15, further comprising passing a shaft through each hole of the one or more first protrusions and one or more second hinge protrusions in a direction along which the first reinforcing bar and the second reinforcing bar are aligned to pivotally hinge the top portion of the first cover to the top portion of the second cover.

17. The method of claim 16, wherein an inner surface of the first cover includes one or more first seating recesses to seat a first lug array formed in the first reinforcing bar and an inner surface of the second cover includes one or more second seating recesses to seat a second lug array formed in the second reinforcing bar, wherein the adjusting positions the one or more second seating recesses to seat the second lug array while the one or more first seating recesses remain in a position to seat the first lug array.

18. The method of claim 17, wherein the first cover and the second cover are further configured to slide along the shaft independent of each other to vary a position of the first seating recesses and the second seating recesses.

19. The method of claim 14, wherein at least one of the first cover or the second cover includes a restraining apparatus configured to restrict an insertion of at least one of the first reinforcing bar or second reinforcing bar to a predetermined depth.

20. The method of claim 14, wherein at least one of the holder or binding member can comprise at least one of stainless steel, aluminum, titanium, plastics, ceramics, or carbon fiber.

* * * * *